United States Patent [19]

Pfender

[11] 4,290,383

[45] Sep. 22, 1981

[54] SPRAYING ARRANGEMENT

[75] Inventor: Thomas E. Pfender, Vanderburgh County, Ind.

[73] Assignee: Creative Craftsmen, Inc., Evansville, Ind.

[21] Appl. No.: 62,337

[22] Filed: Jul. 31, 1979

[51] Int. Cl.[3] ..... B05C 5/00; B05C 15/00

[52] U.S. Cl. ..... 118/630; 118/316; 118/324; 118/326

[58] Field of Search ..... 118/316, 324, 326, 630, 118/631, 634, DIG. 7

[56] References Cited

U.S. PATENT DOCUMENTS

| | | | |
|---|---|---|---|
| 2,486,877 | 11/1949 | Ransburg et al. | 118/326 X |
| 2,996,407 | 8/1961 | Meeker | 118/316 X |
| 3,252,401 | 5/1966 | Smith | 118/326 X |
| 3,386,415 | 6/1968 | Faber | 118/326 X |
| 3,844,818 | 10/1974 | Morrison | 118/301 X |

*Primary Examiner*—John P. McIntosh

*Attorney, Agent, or Firm*—Warren D. Flackbert

[57] ABSTRACT

A spraying arrangement having particular adaptability for use in combination with a conveyor installation characterized by conventional sprayer equipment for painting or coating production parts, where excess paint or coating material is deposited on a back up shield, the latter serving to overcome, or at least minimize, overspray.

Particular importance of the arrangement lies in the fact that the load capabilities of the conveyor can be more fully utilized, i.e. the parts under process can be sprayed from opposite sides of the aforesaid shield, being mounted on the same conveyor hanger.

The shield may be in the form of selectively movable porous material and, in the instance of electrostatic paint spraying, a grid, charged with the same electrical potential as the part, is disposed within passes of the shield for even more effective excess material collecting purposes.

6 Claims, 3 Drawing Figures

SPRAYING ARRANGEMENT

As is known, the usage of conveyors is widespread in manufacturing and/or fabricating facilities. A particular inherent and sometimes unconsidered factor is the use of a conveyor under a considerably lesser loaded condition than actually demanded by the design. In other words, and by way of example, a conveyor could be specified for a 100 lb. product load usage, but, in fact, a much lighter load actually processed. In other words, the total weight capacity for a given conveyor installation is oftentimes ineffectively utilized. In such instance, and particularly where a coating or painting operation is involved, the reduced production rate represents a decided cost disadvantage to the user.

Moreover, another problem is that of overspray, i.e. where the paint or other coating material passes onto an unwanted area of the part under process. In this connection, and again by way of example, perhaps only the top and side surfaces of a part requires painting or coating, where the back or undersurfaces need no attention because of the end use of the product, i.e. painting or like treatment would present an unwanted visual appearance. Thus, a primary object of the spraying arrangement herein is to cover only desired areas of the part or article under treatment.

The invention solves the aforesaid needs, first in permitting an increased painting or coating capacity for a given conveyor installation because the arrangement permits the simultaneous painting or coating of parts in a back-to-back relationship, i.e. the availability of more parts at the same time to fulfill conveyor capacity. Secondly, an absorbent shield or barrier, disposed between vertical banks of parts, plays importance in accumulating any paint or coating material overspray, i.e. any excess paint or coating material passes onto the shield, preventing flow onto any unwanted areas of the production part or article. Accordingly, the preceding affords desirable visual appearance for the processed part or article, resulting in more commercially acceptable value.

Broadly, the spraying arrangement of the invention is used in combination with a typical conveyor installation, where a shield is provided between articles mounted on each conveyor hanger in a back-to-back relationship. Moreover, the shield separates the vertically banked parts or articles from each other and serves, being porous in form, to absorb excess paint or coating material. In that more parts or articles can be mounted for processing on the same conveyor hanger, extra capacity is achieved, utilizing more of the designed hanger load. Thus, the invention affords at least twofold end results, namely added capacity for an existing conveyor installation and a provision for absorbing excess paint or coating material to preclude overspray problems.

Figure 2:
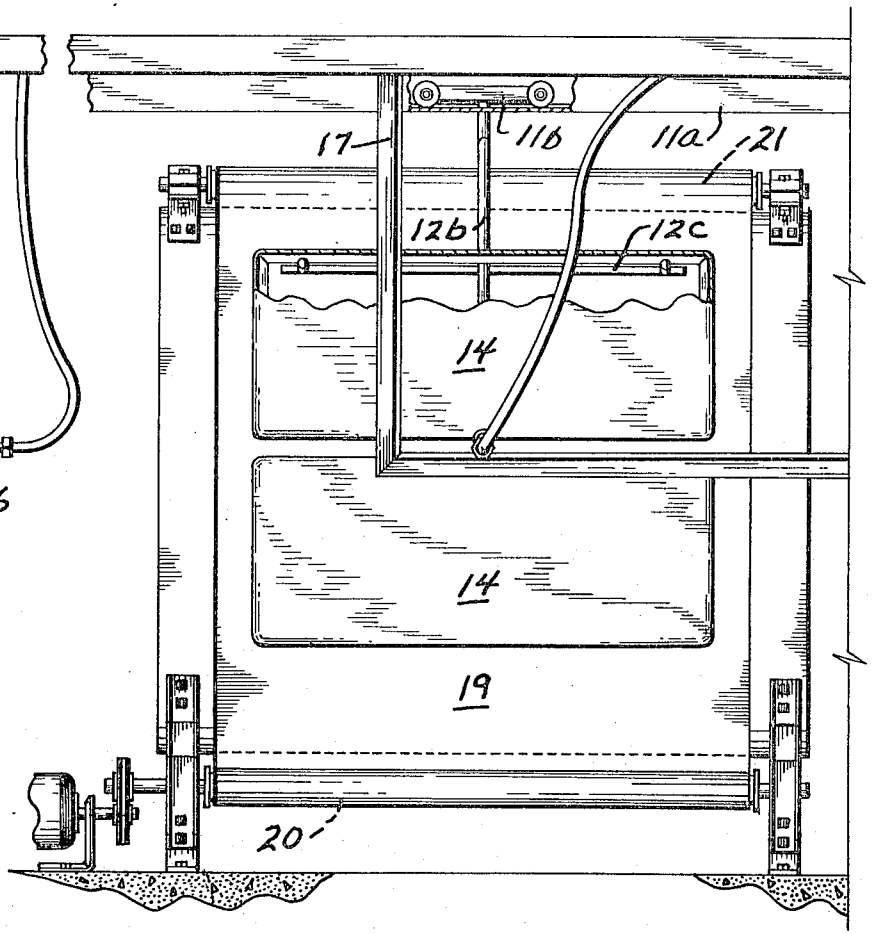
Figure 1:
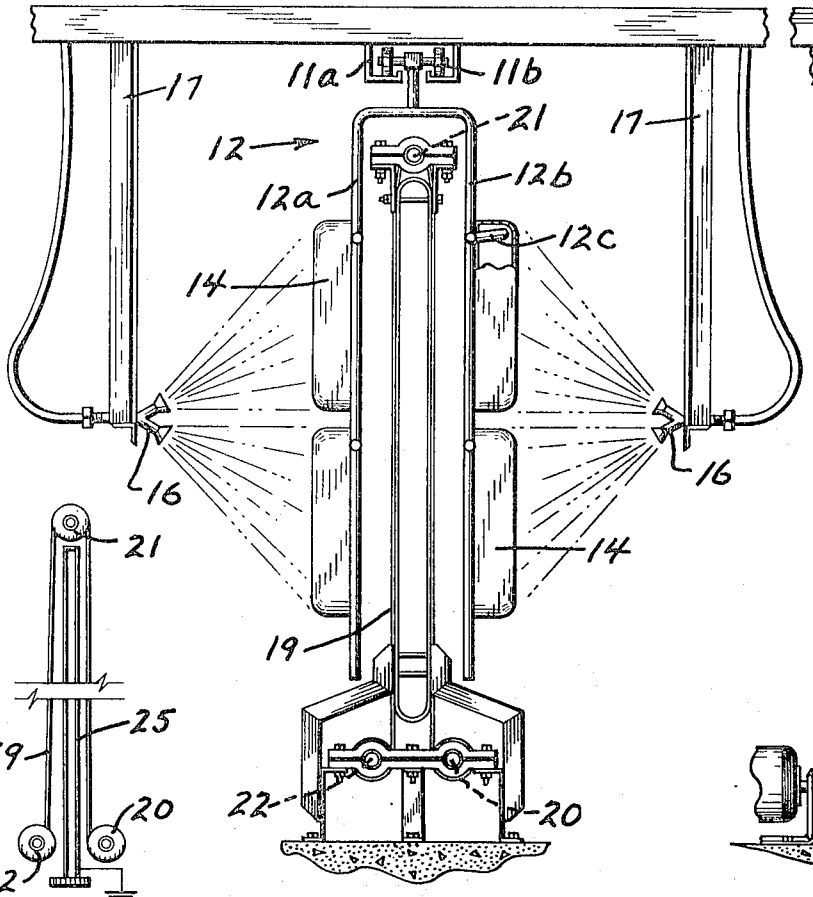
Figure 5:
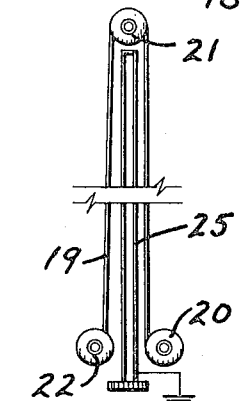

In any event, a better understanding of the present invention will become more apparent from the following description, taken in conjunction with the accompanying drawing, wherein FIG. 1 is a view in elevation showing a typical spraying arrangement in accordance with the teachings of the invention;

FIG. 2 is another view in elevation, in this instance looking from right to left in FIG. 1, showing further details of the instant spraying arrangement; and, FIG. 3 is a further view in elevation, partly fragmentary, showing an alternative embodiment of the invention utilizing a grounded grid, as in the instance of an electrostatic paint spraying operation.

For the purposes of promoting an understanding of the principles of the invention, reference will now be made to the embodiments illustrated in the drawing and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring now to the figures, and particularly to FIGS. 1 and 2, the spraying arrangement of the invention is shown in combination with a conventional conveyor installation for a manufacturing facility. In this regard, and as known, the conveyor typically includes structure, as a track 11*a*, guiding a series of movable trollies 11*b*, each of which, in turn, mounts a hanger 12, the latter being defined by arms 12*a* and 12*b*. Each of the arms 12*a* and 12*b* is arranged to include a bracket 12*c* or the like upon which a part or article 14 being processed is mounted.

The part or article 14 may assume any desired configuration and, typically, and for reasons of illustration, may be an item having a portion, such as the rear undersurfaces, on which no paint or other coating is desired. An example of the preceding would be a component of a conventional household type outdoor grill.

The invention includes conventional sprayer heads 16, mounted on support members 17, and receiving paint, for example, such as enamel, from a source (not shown). In a typical operational sequence, the parts or articles 14 under treatment at the spraying stage have previously been subjected to a washing and drying operation.

The primary importance of the invention lies in the fact that a plurality of extra parts or articles 14 may be simultaneously coated or otherwise treated, oftentimes doubling the conveyor capacity and yet within the design weight limits thereof. In other words, a conveyor is normally designed for a particular weight/pound load and oftentimes, heretofore, only a portion of the available load capacity has been utilized. With the invention, and with the parts or articles 14 arranged on each hanger 12 in a back-to-back relationship, i.e. in vertical banks, more parts or articles 14 can be placed on the brackets 12*c* on the hanger arms 12*a* and 12*b*. Thus, the optimum available conveyor capacity may be used.

A further feature of the invention is the use of a shield 19 between the hanger arms 12*a* and 12*b* and, hence, the vertical banks of parts or articles 14 carried thereby (see FIG. 1). The shield 19, made from an absorbent material, is typically presented from a rolled source and serves to absorb excess paint or coating material and prevent overspray, i.e. the seepage of paint or excess paint onto unwanted areas of the article being sprayed.

More specifically, in a typical arrangement, a rotatable roller 20 stores the shield 19 material, which, thereafter, passes over a rotatable intermediate roller 21 to a rotatable receiving roller 22. As evident, the shield 19 then assumes two generally parallel upright passes. Typically, the shield 19 is in the form of a paper filter, or even gauze, and, if desired, includes a pattern of slits or the like for increased absorbing purposes.

In a preferred invention form, the shield 19 is selectively movable so that lengths of clean or unsprayed areas are made available for receiving the excess paint or coating material. In other words, the operator may cause the selective movement of the shield 19 in accordance with spraying conditions.

Thus, parts or articles 14, increasing the treating capacity of the hangers 12, are simultaneously sprayed from the sprayer heads 16 as such parts or articles 14 pass through the painting or conditioning area. Instead of a single part or article 14 being painted or treated, a plurality of articles are processed through the use of more of the available load capacity of each hanger 12, with the added advantage of precluding or at least minimizing overspray.

With reference to FIG. 3, and in another invention embodiment, a grid 25 may be disposed within the confines of the vertical passes of the shield 19. The preceding structure is of particular importance in the instance of electrostatic paint spraying, where the grid 25, which may be formed from wires, is at the same electrical potential as the part or article 14, inducing the paint onto the absorbent shield 19 and serving to further minimize overspray.

From the preceding, it should be evident that the invention provides for increased article or part 14 capacity for conveyor type spraying techniques and, as well, as an arrangement for accumulating excess paint or coating material for a better finished product. The shield 19 may assume various forms and/or configurations including, by way of example, a frame mounted absorbent panel (not shown) arranged between the banks of parts or articles 14 which may be selectively placed and, thereafter, removed when the absorbency limit thereof has been attained. Alternatively, a water wash curtain (also not shown) may be utilized for the excess material removal purposes.

Moreover, "simultaneous(ly)" as used herein is meant to include painting and/or coating of the parts or articles at staggered locations along and at opposite sides of the processing area, notwithstanding the fact that the parts or articles are in a back-to-back relationship or in banks in a back-to-back relationship on the conveyor hangers 12. The preceding is significant, among other reasons, in the instance where operators would directly face each other and such might prove objectionable during the painting/coating procedure.

In any event, the instant spraying arrangement is highly advantageous and commercially adaptable for many end uses, and the forms described herein are subject to modification within the spirit of the invention. In this connection, and by way of example, proportioning and dimensioning may be varied, the mounting of the shield 19 modified, the type of material defining the shield 19 changed to accommodate the particular paint, coating or treating substances involved, and the like. Thus, the preceding should be considered illustrative and not as limiting the scope of the following claims:

I claim:

1. In combination with a conveyor installation including structure supporting a single line of hangers adapted to receive articles for spray processing, a spraying arrangement comprising sprayer equipment disposed on opposite sides of said single line of hangers and facing in the direction of articles carried therebetween, said articles carried on said hangers being in oppositely facing directions and separated by an upstanding overspray collecting shield which permits the simultaneous spraying of articles on both sides of said overspray collecting shield and multiple spray processing capacity for said single hanger line.

2. The combination of claim 1 where said overspray collecting shield has absorbent physical properties.

3. The combination of claim 2 where said overspray collecting shield is selectively movable to present an unused absorbent area.

4. The combination of claim 2 where said overspray collecting shield is porous.

5. The combination of claim 1 where said overspray collecting shield is defined by upright passes having a grid disposed therebetween, and where said grid is at the same electrical potential as said articles.

6. The combination of claim 1 where said overspray collecting shield is fed from a rotatable storage roller to a rotatable receiving roller, and where a rotatable intermediate roller around which said overspray collecting shield travels defines vertical passes of said overspray collecting shield.

* * * * *